United States Patent [19]

Dakroub

[11] 4,262,234

[45] Apr. 14, 1981

[54] SCR LAMP SUPPLY TRIGGER CIRCUIT

[75] Inventor: Housan Dakroub, Dearborn Heights, Mich.

[73] Assignee: Burroughs Corporation, Detroit, Mich.

[21] Appl. No.: 84,351

[22] Filed: Oct. 12, 1979

[51] Int. Cl.[3] ..... G05F 1/00; H05B 41/36; H05B 37/02; H05B 31/00

[52] U.S. Cl. ..... 315/291; 315/199; 315/209 SC; 315/240; 315/DIG. 7; 355/69

[58] Field of Search ..... 315/209 SC, 291, 194, 315/199, 205, DIG. 7, 240; 355/69

[56] References Cited

U.S. PATENT DOCUMENTS 3,443,154 5/1969 Hoekstra et al. ..... 315/240

*Primary Examiner*—Alfred E. Smith
*Assistant Examiner*—Thomas P. O'Hare
*Attorney, Agent, or Firm*—Kenneth J. Cooper; Charles E. Quarton; Kevin R. Peterson

[57] ABSTRACT

A silicon controlled rectifier (SCR) lamp supply trigger circuit, responsive to control circuitry, produces trigger currents for the SCR which transmits the required voltage to illumination lamps in a document image capturing system. The trigger circuit includes a single AC input supply voltage having a positive and negative portion and electronic components for accumulating the respective voltage portions and isolating them to avoid unwanted signal interference with the control circuitry regulating the lamp supply voltage. Devices discharge the voltage accumulating components in response to the control circuitry of the SCR lamp supply and feed the discharged voltage to an apparatus for conversion to a current for triggering the SCR. Residual voltages remaining on the voltage accumulating components are automatically discharged during that portion of the AC input supply voltage which is opposite to the polarity of the charges stored on the voltage accumulating components. Furthermore, the trigger circuit provides for the gradual illumination of the lamps to prolong their serviceability.

7 Claims, 11 Drawing Figures

CONTROL CIRCUIT
26
$C_3$
+10V
44
46
48
$C_4$
50
$C_1$
36
22
+AC PORTION
$T_1$
53
$60_2$
56
56
$T_2$
54
66
I
$C_2$
38
22
-AC PORTION $SCR_1$
$SCR_2$
A
C
G
58
62
+AC PORTION
-AC PORTION
$V_{DC}$ TO LAMPS
34

A=ANODE C=CATHODE G=GATE

SCR1
SCR2
A
C
G
+ AC PORTION
− AC PORTION
VDC TO LAMPS
22
58
62
64
65
34
1
2
3
4
5
6
7
8

AC INPUT SUPPLY VOLTAGE
RECTIFIED AC INPUT SUPPLY VOLTAGE
TIME
TIME
NEGATIVE PORTION
POSITIVE PORTION
SCR FIRING
VOLTS
+
0
−
+
0
−

SCR1
SCR2
A
C
G
+ AC PORTION
− AC PORTION
VDC TO LAMPS
22
58
62
64
34
1
2
3
4
5
6
7

SCR1
SCR2
A
C
G
+ AC PORTION
− AC PORTION
VDC TO LAMPS
22
58
62
64
65
67
68
34
1
2
3
4
5
6
7
8

SCR LAMP SUPPLY TRIGGER CIRCUIT

BACKGROUND OF THE INVENTION

1. Field of the Invention

This invention relates to a silicon controlled rectifier (SCR) lamp supply trigger circuit, responsive to control circuitry, to produce trigger currents for the SCR which transmits the required voltage to illumination lamps in a document image capturing system.

2. Description of the Prior Art

Prior circuits for supplying current pulses to trigger a silicon controlled rectifier (SCR) transmitting voltage to illumination lamps have principally relied on an additional power supply. This dependence resulted in the need to generate large current pulses to trigger the SCR while the control circuitry regulating the lamp supply voltage required only low levels of current. When the same large current supply was used for both applications, signal interference in the control and trigger circuits appeared. However, the dual power supply approach was recognized to be a costly solution to the large trigger current pulse requirements of the SCR. In addition, more room was needed to contain the separate transformer and associated parts for the current pulse generation.

The invention to be disclosed offers a single voltage supply trigger circuit which will provide the large trigger currents for the SCR without electrically interfering with the power requirements of the control and trigger circuits regulating the lamp supply voltage to the illumination lamps.

SUMMARY OF THE INVENTION

A silicon controlled rectifier (SCR) lamp supply trigger circuit, responsive to control circuitry, produces trigger currents for the SCR which transmits the required voltage to illumination lamps in a document image capturing system. The trigger circuit utilizes a single AC input supply voltage having a positive and negative portion and a first and second resistor-capacitor network which respectively accumulate the positive and negative voltage portions. These voltages are isolated from the system's circuits controlling the lamp supply voltage so that upon the capacitors' rapid discharge, signal interference is avoided.

To discharge the first and second resistor-capacitor networks at a predetermined instant dictated by the control circuitry of the SCR lamp supply, a voltage comparator for each network turns on to furnish a current path for the accumulated voltage. These comparators alternately discharge their corresponding capacitors only during their corresponding portions of the AC input supply voltage so that overlapping voltage polarities and uncontrolled capacitor discharging is prevented.

The voltage from each capacitor is converted to a current for triggering the SCRs by a discharge path through a transformer primary which induces the trigger current in a transformer secondary coupled to the SCRs. This trigger current turns the SCR on to transmit a desired voltage level to the lamps.

After the first and second resistor-capacitor networks are each discharged, residual voltages are automatically discharged during that portion of the AC input supply voltage which is opposite to the polarity of the voltage stored on the respective networks. A reset transistor senses the completion of the positive and negative portions of the AC input supply voltage and transmits an output at that instant. The output causes a comparator to timely discharge the residual voltages on the networks.

To prolong the serviceability of the lamps, the invention includes circuitry to gradually increase their illumination when the system is initially energized. A transistor is switched to ground upon turning on the system, a device coupled to the transistor stores a fractional amount of the voltage shunted to the transistor, and a rectifier, coupled to the voltage device, gradually allows the magnitude of the AC supply voltage, transmitted to illuminate the lamps, to increase.

DETAILED DESCRIPTION

Figure 1:
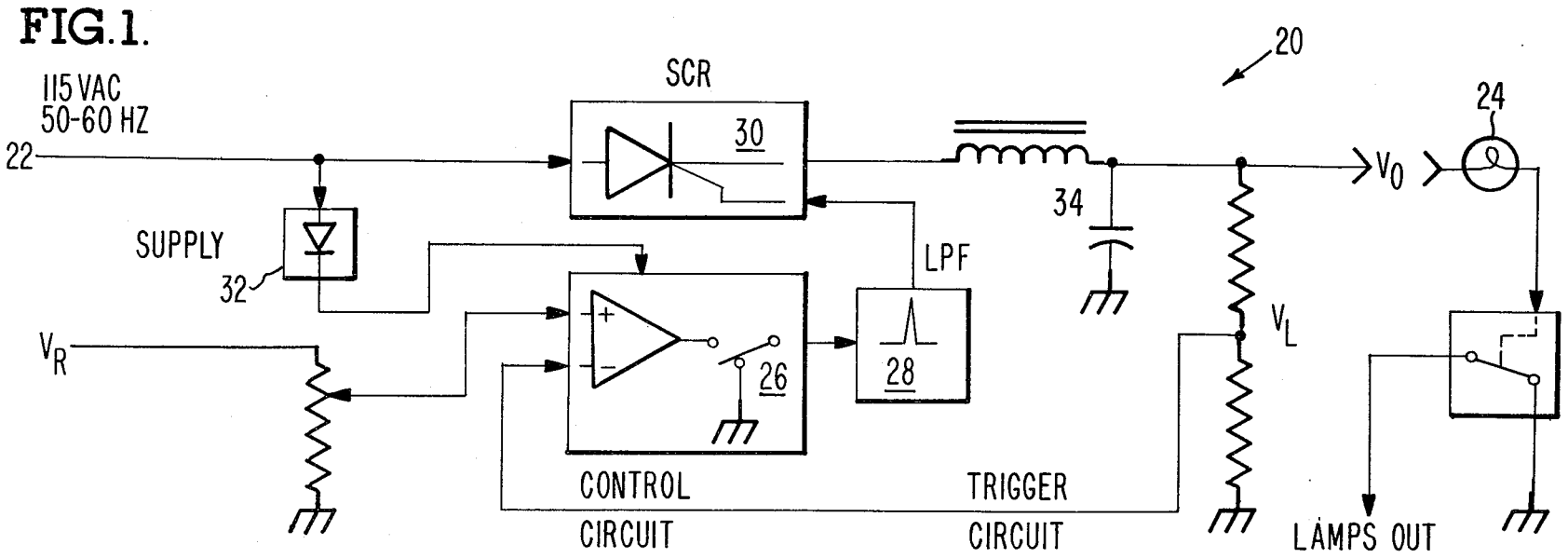
FIG. 1 is a block diagram of the interaction of the silicon controlled rectifier (SCR), control and trigger circuits for regulating the voltage transmitted to illumination lamps in a document image capturing system.

In a document image capturing system 20 (FIG. 1), a single voltage supply 22 is utilized to power the document illumination lamps 24, control circuit 26, and trigger circuit 28. To regulate the amount of power transmitted to the lamps 24, the system 20 includes a silicon controlled rectifier (SCR) 30 responsive to the control and trigger circuits, 26 and 28 respectively.

In general, a single voltage supply 22 of 115 volts AC is rectified at 32 and powers the control and trigger circuits as well as the 1,000 watt illumination lamps 24. A selected reference voltage $V_R$ for controlling the lamp voltage is fed to the input of control circuit 26 (for a more detailed description of the control circuit, see the applicant's copending application entitled SCR Lamp Supply, filed Aug. 24, 1979 Ser. No. 069,562). The control circuit also receives a predetermined portion of the voltage $V_L$ delivered to the lamps 24. The sensed portion of $V_L$ is then compared to $V_R$ and the difference is fed to trigger circuit 28. At the appropriate instant, the trigger circuit transmits a current pulse to turn on the SCR 30 and permit the desired magnitude of voltage to flow through a low pass filter 34 to the lamps 24.

Figure 2:
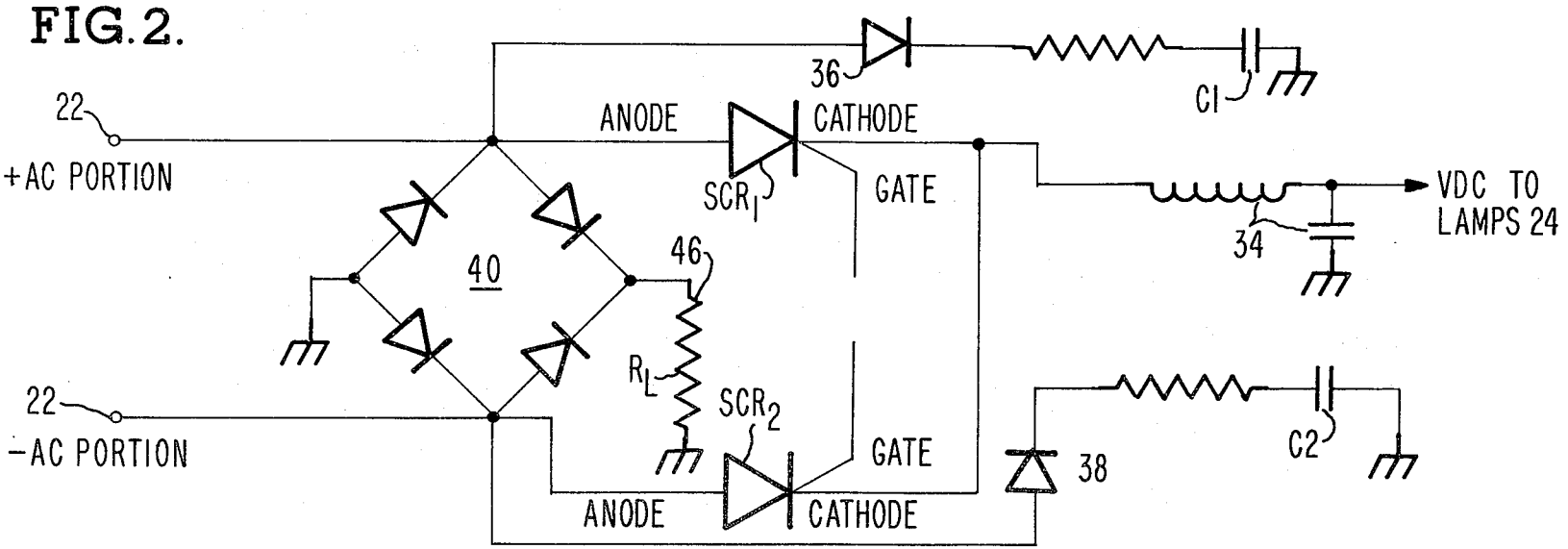
FIG. 2 illustrates both the rectifying circuitry to supply voltage to the control and trigger circuit and the circuitry for charging the trigger capacitors.

Referring to FIG. 2, SCR triggering capacitors $C_1$ and $C_2$ are charged directly by the AC input voltage supply 22. $C_1$ receives only the positive portion of the AC voltage due to diode 36 while $C_2$ is negatively charged due to diode 38. To power the remainder of the control and trigger circuits, represented by load resistor $R_L$, the same AC voltage source is rectified by the diode bridge network 40. These circuits require very little current relative to the demands of the lamps 24. Also, the current from the AC voltage source is prevented from going to the lamps because $SCR_1$ and $SCR_2$, in their untriggered state, have an open path between their anode and cathode. To release the accumulated charge on $C_1$ (FIG. 3), current from the control circuit 26 charges capacitor $C_3$ until the accumulated voltage equals the value supplied to the inverting input of comparator 44 (LM 339, manufactured by National Semiconductor Corporation, 2900 Semiconductor Drive, Santa Clara, California, 95051). Prior to attaining this equality, the DC supply voltage 46 conducts current through resistor 48 into the output of comparator 44 which is internally switched to ground when unequal voltage inputs are present. Consequently, capacitor $C_4$ receives no charging current, switching transistor 50 (2N3009, manufactured by RCA Solid State, Box 3200, Somerville, New Jersey, 08876) remains off, and no rapid discharge path is available for triggering capacitor $C_1$.

When the voltage on $C_3$ equals the value supplied to the inverting input of comparator 44, typically 10 volts, the path to ground through comparator 44 switches open, the DC supply voltage 46 charges $C_4$, and current flows to turn on switching transistor 50 which closes a path to ground between its collector and emitter. The chosen value of $C_4$ also limits the amount of current delivered to switching transistor 50. At the instant of closing the path to ground, triggering capacitor $C_1$ discharges its accumulated voltage along this path by sending a current pulse through transformer $T_1$ and switching transistor 50. The direct path to ground is significant because the pulse of discharged voltage and current from triggering capacitor $C_1$ is isolated from other portions of the control and trigger circuits to prevent signal and operational interference.

To discharge the negative portion of the AC supply voltage accumulated on trigger capacitor $C_2$, a second network of components identical to those involved with $C_1$ follows the same steps as previously described.

Figure 4:
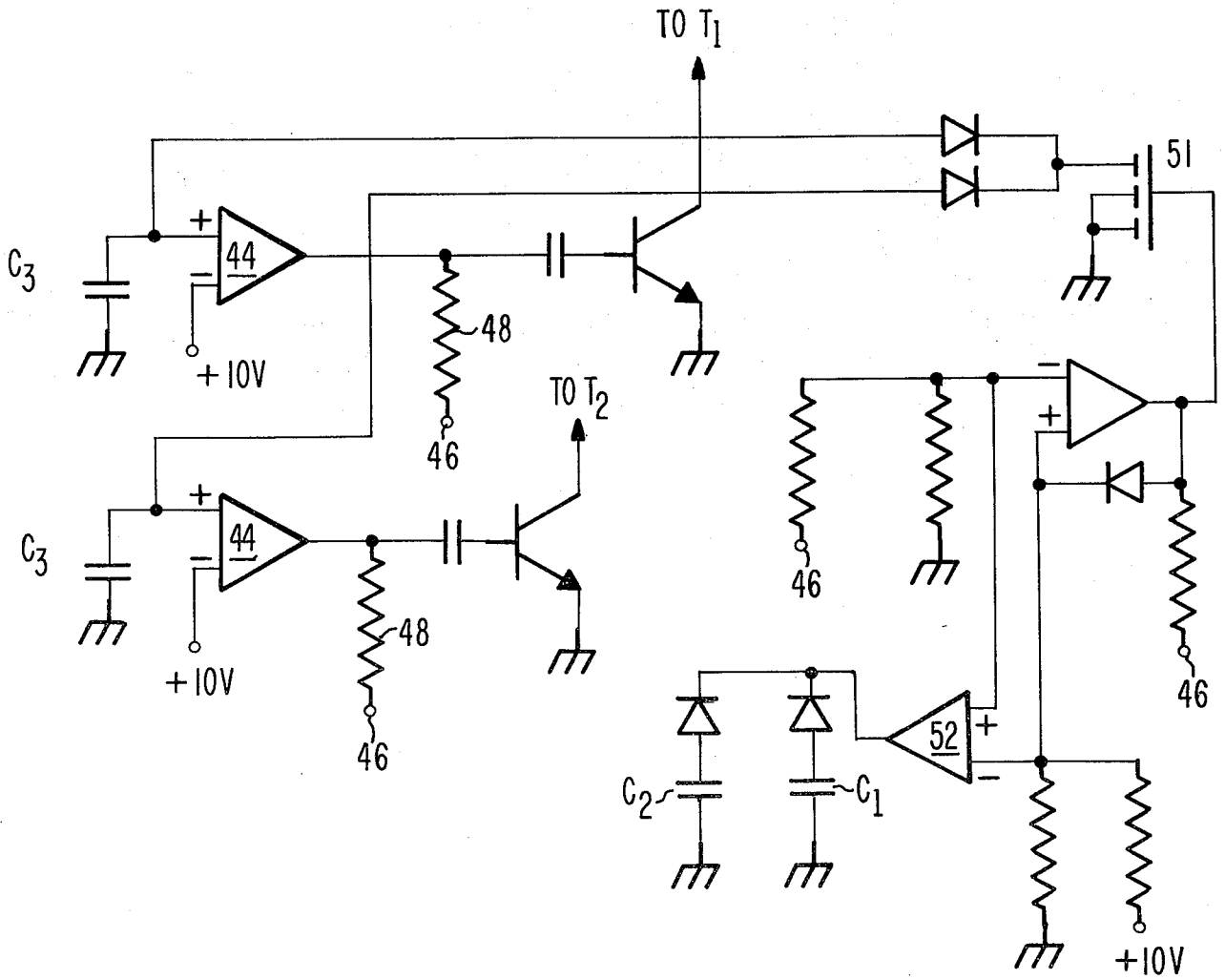
FIG. 4 illustrates the circuit for resetting the trigger capacitors.

At the end of each half cycle of AC input supply voltage, triggering capacitors $C_1$ and $C_2$ must be fully discharged so that a residual charge is not present when their next appropriate half cycle occurs. Such a residual charge could result in a subsequent discharge of a damaging amount of current not otherwise anticipated when switching transistor 50 closes its path to ground. Consequently, a reset transistor-capacitor network (FIG. 4) senses the completion of a given half cycle. At that instant, the reset transistor 51 (SD5200, manufactured by Signetics Corporation, P.O. Box 9052, Sunnyvale, California, 94086) pulses reset comparator 52 (LM339, manufactured by National Semiconductor Corporation, 2900 Semiconductor Drive, Santa Clara, California, 95051) which closes a path to ground to discharge any residual charges on the fired $C_1$ or $C_2$.

Figure 5:
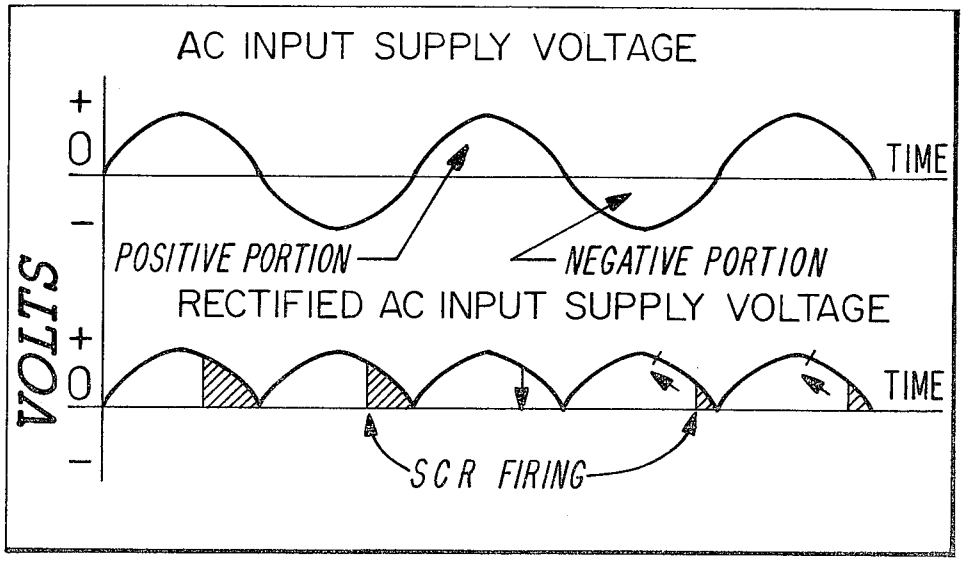
FIG. 5 depicts a portion of a rectified AC waveform used to trigger the SCR.

If the control circuit 26 (FIG. 1) senses a variation between the reference voltage $V_R$ and the predetermined portion of the voltage $V_L$ delivered to the lamps, a varying amount of current is transmitted to the trigger circuit 28. This current is then fed to charge capacitor $C_3$ (FIG. 3) used to switch on comparator 44. The greater the current to $C_3$, the more rapidly $C_3$ reaches the voltage level needed to switch comparator 44. The quicker comparator 44 switches on, the sooner switching transistor 50 closes the path to ground which discharges triggering capacitor $C_1$ to induce the current which discharges triggering capacitor $C_1$ to induce the current which fires $SCR_1$. Likewise, the sooner the half cycle $SCR_1$ is fired, the greater the voltage transmitted to the lamps to restore the equality between $V_R$ and the sensed portion $V_L$ (FIG. 5).

The discharge of trigger capacitors $C_1$ and $C_2$ is channeled through the primary coils 53 and 54 (FIG. 3) of transformers $T_1$ and $T_2$ respectively. The diodes 56 at the junction of the path leading to switching transistor 50 prevent the discharge currents of $C_1$ and $C_2$ from flowing to their counterpart to add to the existing accumulated charge. The absence of this one-way discharge could yield circuit damaging discharge currents from $C_1$ and $C_2$ of unknown and uncontrolled magnitudes.

Figures 3, 3A, 3B:
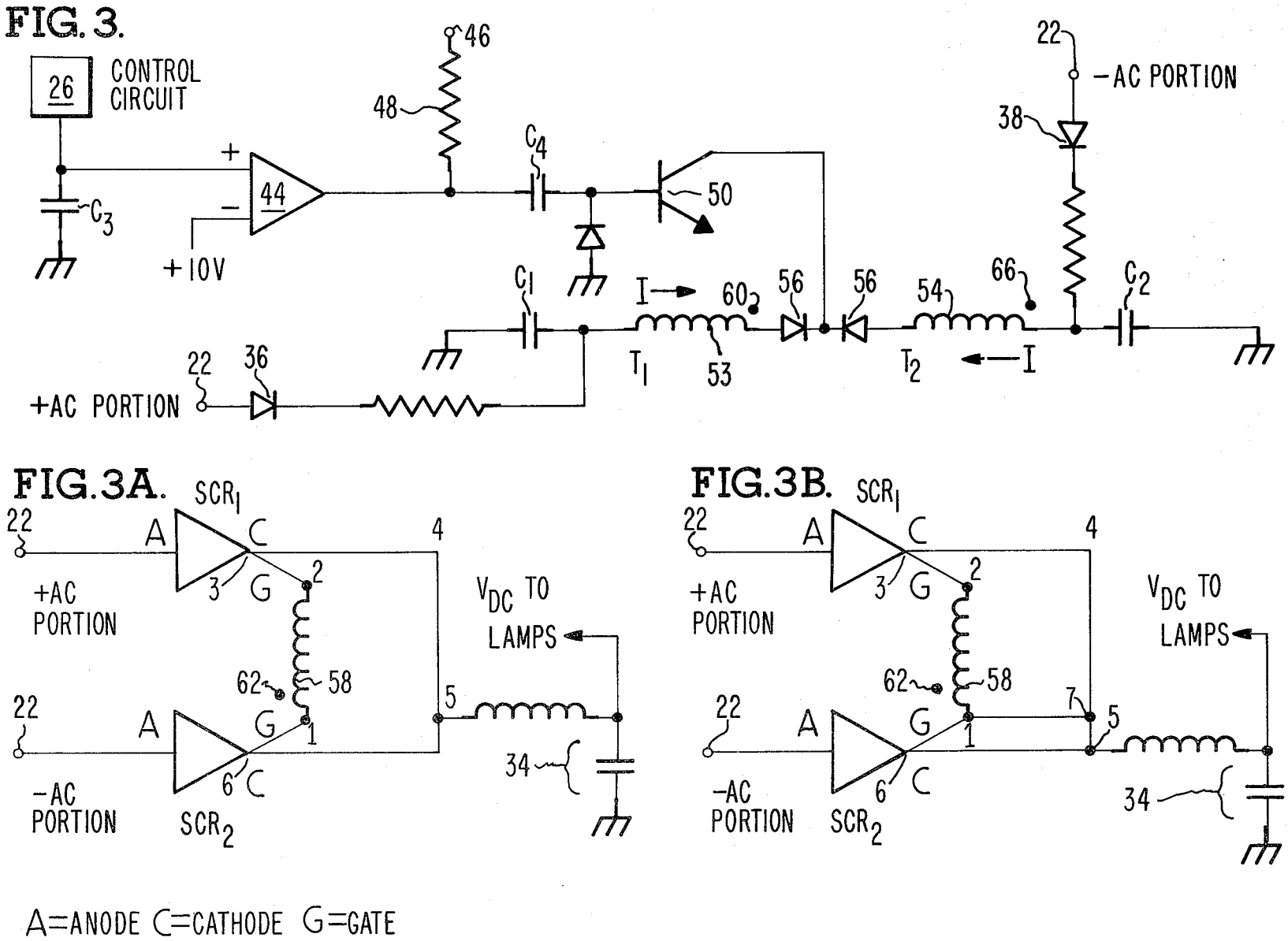
FIG. 3 depicts the trigger circuit for a SCR lamp supply.
FIGS. 3A–3E depict the development of suitable current paths for triggering the SCRs.

The flow of current through the primary coils of $T_1$ and $T_2$ induces the trigger current of opposite polarity in the secondary coil 58 (FIG. 3A) of $T_1$ and $T_2$ which is coupled to the gate input of $SCR_1$ and $SCR_2$. When the positive portion of AC voltage is discharged from $C_1$ (FIG. 3), the current flows through the primary coil 53 of $T_1$ and coil polarity designating dot 60. Since a current of opposite polarity is thereby induced in the secondary coil 58 (FIG. 3A), the trigger current will flow first through the polarity designating dot 62 then through the secondary coil 58 and into the gate of $SCR_1$. However, because current will not flow out of the gate of either SCR, the circuit of FIG. 3A provides no closed path for the current to return to secondary coil 58. As a result, the SCRs will not be triggered and the voltage available at their anodes will not be transmitted to the illumination lamps 24 (FIG. 1).

FIG. 3B depicts a circuit for triggering $SCR_1$. This current flows through the polarity designating dot 62 and into the gate of $SCR_1$ along the nodal path 1, 2, 3, 4, 7, 1. The path between the anode and cathode of $SCR_1$ is closed and the voltage available at the anode of $SCR_1$ is conducted to the illumination lamps. The drawback of this circuit is that the path between nodes 1 and 7 is a short circuit to the gate and cathode of $SCR_2$. FIG. 3C illustrates an improved circuit incorporating diode 64 to prevent this gate-cathode short circuiting of $SCR_2$. Nevertheless, $SCR_2$ still remains unutilized since no return path exists for current induced in secondary coil 58 from node 2 to 1. The properties of an SCR will not permit current to flow from node 4 to 3 and out the gate of $SCR_1$.

Figure 3D:
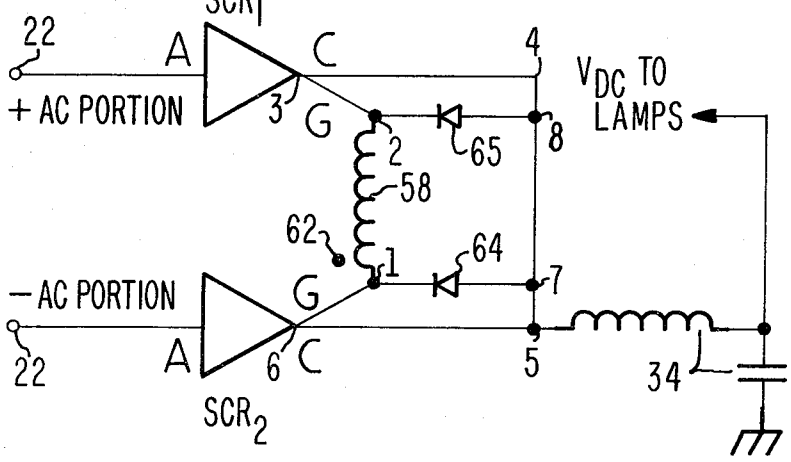
Figure 3C:
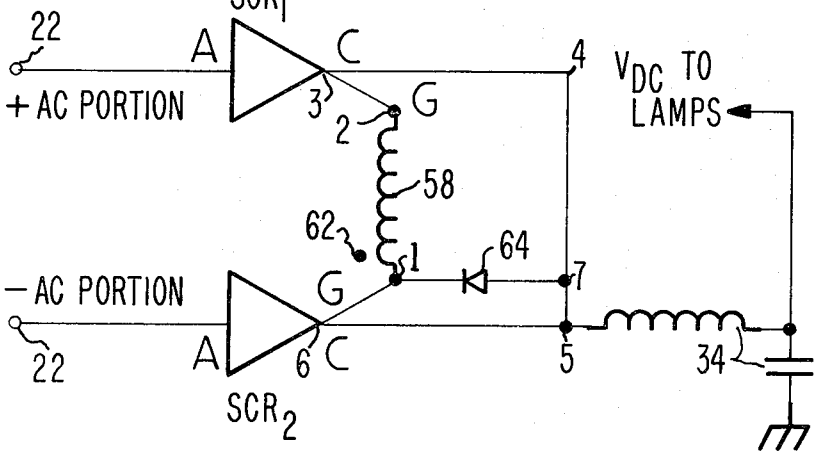
Figure 3E:
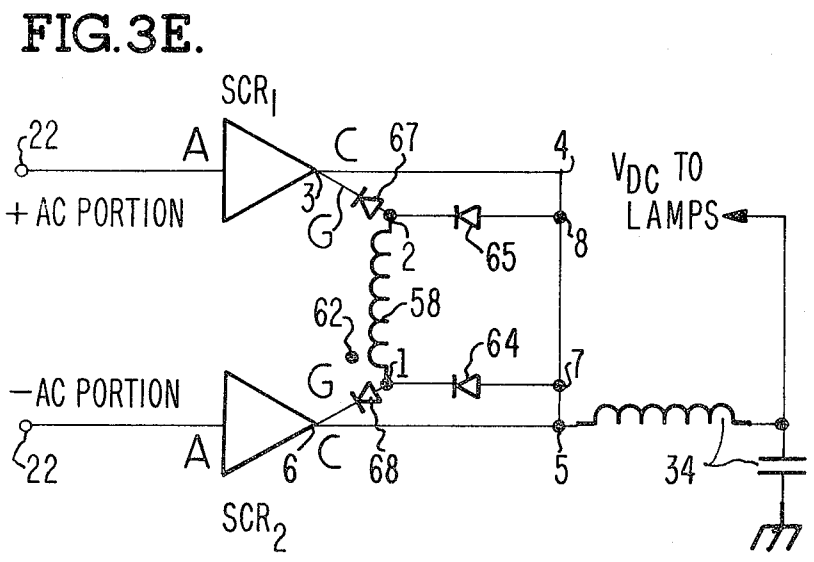

The circuit of FIG. 3D provides noninterferring return paths for induced currents of opposite polarities and avoids a gate-cathode short circuiting of $SCR_2$ by adding diode 65 between nodes 2 and 8. This circuit is finally improved to the configuration shown in FIG. 3E with diodes 67 and 68 added to insure that current only enters the gates of the SCRs.

When a flowing current from node 1 to 2 is induced in secondary coil 58 by the discharge of $C_1$ (FIG. 3) through the primary coil 53 of $T_1$, diode 65 (FIG. 3E) prevents a current transmission to node 8. Instead, the induced current is directed through diode 67 into the gate of $SCR_1$, to nodes 4, 8, 7, and back to node 1 to complete the closed current path for triggering $SCR_1$. The triggered $SCR_1$ closes the path from its anode to cathode and conducts the positive portion of the rectified AC input supply voltage (FIG. 5) at the anode of $SCR_1$ to the illumination lamps 24 (FIG. 1).

Similarly, when trigger capacitor $C_2$ (FIG. 3) discharges the negative portion of the AC input voltage, the current flows into the polarity designating dot 66 then through $T_2$'s primary coil 54. An opposite current is induced in the secondary coil 58 (FIG. 3E) flowing through the coil then into the secondary polarity indicating dot 62 (from nodes 2 to 1). Diode 64 forces the current to flow through diode 68 to enter the gate of $SCR_2$ (node 6), trigger $SCR_2$, and follow the nodal path 6, 5, 7, 8, 2, 1. As with triggered $SCR_1$, the negative portion of the rectified AC input supply voltage (FIG. 5) at the anode of $SCR_2$ (FIG. 3E) is conducted through the now closed path to the cathode of $SCR_2$ and the lamps 24 (FIG. 1).

Figure 6:
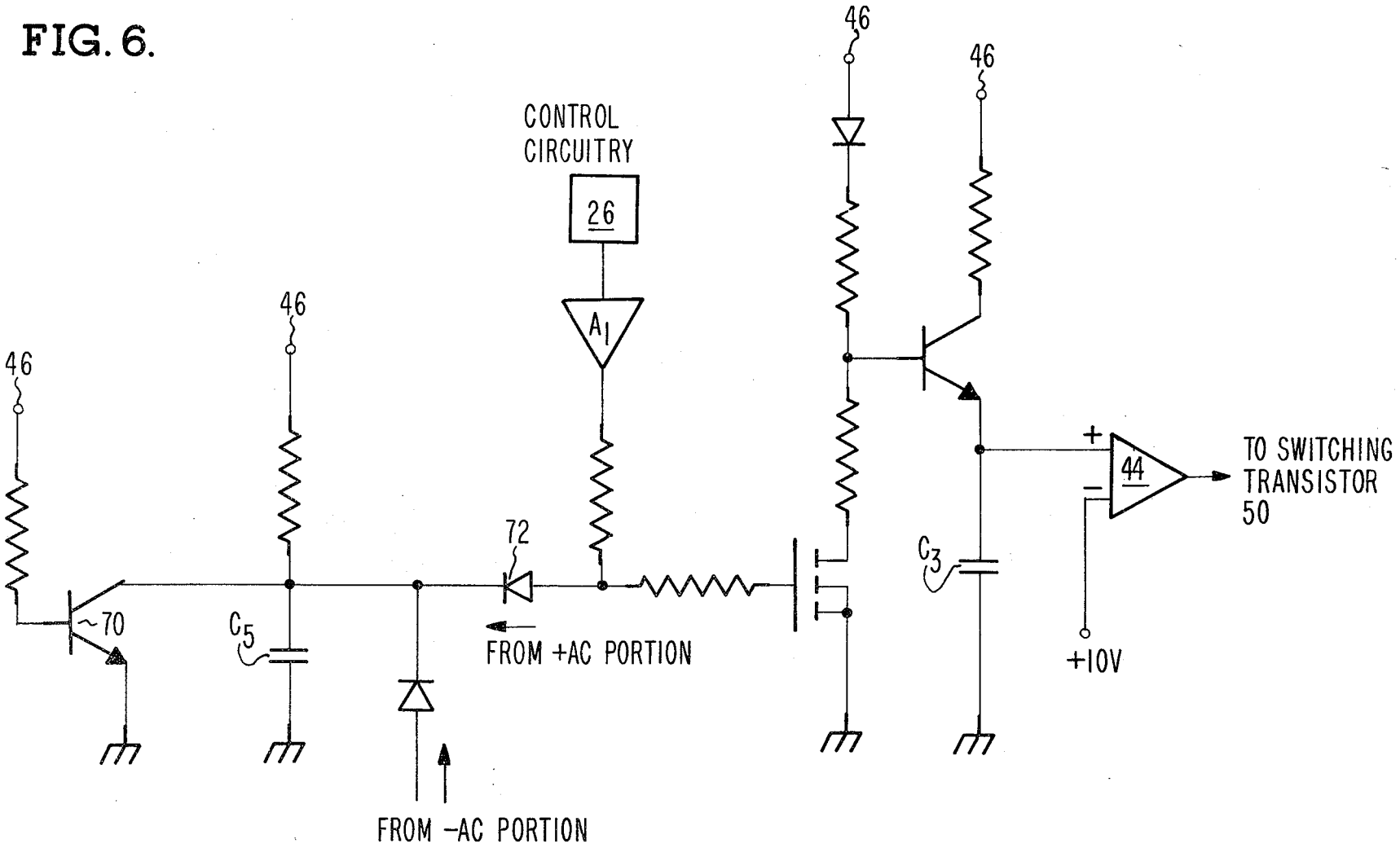
FIG. 6 illustrates the circuitry used to slowly illuminate the lamps upon turning on the document image capturing system.

An additional feature of the trigger circuit permits the lamps to be gradually illuminated to prolong their serviceable lives. This "soft start" occurs when the document image capturing system is energized (FIG. 6). At that time, soft start switching transistor 70 (2N3009, manufactured by RCA Solid State) is biased in the "on" condition which closes a path to ground between its collector and emitter. This allows little current to charge capacitor $C_5$ and causes operational amplifier $A_1$ (LM324, manufactured by National Semiconductor Corporation), coupled to transmit only the positive portion of the AC input supply voltage (An identical operational amplifier with corresponding circuitry is included in the trigger circuit to transmit only the negative portions of the AC input supply voltage.), to feed most of its output current through diode 72 to the transistor's ground. The small currents not transmitted to ground or $C_5$ slowly charge capacitor $C_3$ to the switching voltage for comparator 44 (FIG. 3). Since this voltage accumulation will involve more time, $SCR_1$ will be fired late in the positive half cycle (FIG. 5) and thereby transmit a low voltage level to the lamps.

In time, $C_5$ (FIG. 6) will acquire more voltage to retard the transmission of current from $A_1$ through diode 72. As less current from $A_1$ is diverted from $C_3$, comparator 44 (FIG. 3) begins switching sooner, $SCR_1$ turns on sooner during the positive half cycle, and more voltage is delivered to the lamps to increase their illumination. Finally, when $C_5$ (FIG. 6) is charged such that diode 72 no longer conducts current, all of the current from $A_1$ is transmitted to $C_3$ for triggering $SCR_1$. Continued switching of the SCR is subsequently regulated by the control circuit 26 (FIG. 1) as earlier described.

What is claimed is:

1. A silicon controlled rectifier (SCR) lamp supply trigger circuit, responsive to control circuitry, to produce trigger currents for the SCR which transmits the required voltage to illumination lamps in a document image capturing system, comprising:

a single AC input supply voltage having a positive and negative portion;

a first means for accumulating the positive portion of the AC input voltage and isolating that accumulated portion to avoid unwanted signal interference with the control circuitry regulating the lamp supply voltage;

a second means for accumulating the negative portion of the AC input voltage and isolating that accumulated portion to avoid unwanted signal interference with the control circuitry regulating the lamp supply voltage;

means for discharging the first and second voltage accumulating means in response to the control circuitry of the SCR;

means for converting the discharged voltages from the first and second voltage accumulating means to a current for triggering the SCR of the lamp supply circuits;

means for automatically discharging residual voltages on the first and second voltage accumulating means during that portion of the AC input supply voltage which is opposite to the polarity of the voltage stored on the respective voltage accumulating means; and means for gradually illuminating the lamps to prolong their serviceability.

2. The invention of claim 1, wherein the first and second voltage accumulating means each comprises a resistor-capacitor network which slowly draws current from the AC input supply voltage and accumulates on the capacitor a voltage for subsequent discharge through the means for converting the voltage to a current for triggering the SCR.

3. The invention of claim 1, wherein the means for discharging the first and second voltage accumulating means at a predetermined voltage level comprises;

a first comparator for discharging the accumulated positive portion of AC input voltage on the first voltage accumulation means; and a second comparator for discharging the accumulated negative portion of AC input voltage on the second voltage accumulation means.

4. The invention of claim 3, wherein the first and second comparators alternately discharge their corresponding voltage accumulating means so that only the first voltage accumulating means is discharged during the positive portion of the AC input voltage and only the second voltage accumulating means is discharged during the negative portion of the AC input voltage.

5. The invention of claim 1, wherein the means for converting the discharged voltage from the first and second voltage accumulating means to a current for triggering the SCR of the lamp supply circuit comprises a transformer primary coil coupled to each voltage accumulating means and a transformer secondary coil coupled to the SCR.

6. The invention of claim 1, wherein the means for automatically discharging residual voltages on the first and second voltage accumulating means during that portion of the AC input supply voltage which is opposite to the polarity of the voltage stored on the voltage accumulating means comprises:

a reset transistor for sensing the completion of the positive and negative portions of the AC input supply voltage and transmitting an output at that instant; and a comparator, responsive to the output of the reset transistor, for timely discharging the residual voltages on the first and second voltage accumulating means.

7. The invention of claim 1, wherein the means for gradually illuminating the lamps comprises:

a transistor switched to ground upon turning on the document image capturing systems;

a third means for accumulating voltage, coupled to the transistor, to store a fractional amount of the voltage shunted to the transistor; and a rectifier, coupled to the third voltage accumulating means, for gradually increasing the magnitude of the AC input supply voltage transmitted to illuminate the lamps.

* * * * *